US006968655B2

(12) United States Patent
Lawrence

(10) Patent No.: US 6,968,655 B2
(45) Date of Patent: Nov. 29, 2005

(54) STEP SUPPORT METHOD FOR USE IN THE MANUFACTURING OF STRAIGHT OR CURVED STAIRS

(76) Inventor: Michael J. Lawrence, 35 SE. Bridgeford Blvd., Unit B, Bend, OR (US) 97702

( * ) Notice: Subject to any disclaimer, the term of this patent is extended or adjusted under 35 U.S.C. 154(b) by 0 days.

(21) Appl. No.: 10/825,825

(22) Filed: Apr. 16, 2004

(65) Prior Publication Data

US 2004/0194403 A1 Oct. 7, 2004

Related U.S. Application Data

(63) Continuation of application No. 09/803,164, filed on Mar. 9, 2001, now abandoned, which is a continuation-in-part of application No. 09/419,226, filed on Oct. 15, 1999, now abandoned.

(60) Provisional application No. 60/104,574, filed on Oct. 16, 1998.

(51) Int. Cl.[7] ..... E04F 11/00

(52) U.S. Cl. ..... 52/191

(58) Field of Search ..... 52/182–184, 188, 52/191, 187

(56) References Cited

U.S. PATENT DOCUMENTS

| | | | | |
|---|---|---|---|---|
| 485,449 A | * | 11/1892 | Borneman et al. | 52/187 |
| 697,434 A | | 4/1902 | Beardsley | |
| 1,241,976 A | | 10/1917 | Hill | |
| 1,925,642 A | | 9/1933 | Meredith | |
| 2,287,561 A | | 6/1942 | Page et al. | |
| 2,297,101 A | | 9/1942 | Greenwell et al. | |
| 2,724,466 A | | 11/1955 | Phillips | |
| 2,818,945 A | | 1/1958 | Holzer | |
| 2,879,556 A | * | 3/1959 | Lyons | 52/191 |
| 3,196,997 A | * | 7/1965 | Hager | 52/182 |
| 3,418,770 A | | 12/1968 | Allmand | |
| 3,473,275 A | | 10/1969 | Lappin, Jr. | |
| 3,909,997 A | | 10/1975 | Eickhof | |
| 3,962,838 A | | 6/1976 | Cox | |
| 3,999,350 A | | 12/1976 | MacKenzie | |
| 4,015,687 A | | 4/1977 | Dean | |
| 4,106,591 A | | 8/1978 | Cohen et al. | |
| 4,124,957 A | | 11/1978 | Poulain | |
| 4,367,613 A | | 1/1983 | Strub | |
| 4,583,334 A | | 4/1986 | Hubbard | |
| 4,635,416 A | | 1/1987 | Ayala | |
| 4,709,520 A | | 12/1987 | Vochatzer | |
| 4,866,894 A | | 9/1989 | Brown | |
| 4,875,315 A | | 10/1989 | Champagne | |
| 5,140,755 A | | 8/1992 | Simmons, Jr. | |
| 5,186,874 A | | 2/1993 | McLaughlin | |
| 5,205,093 A | | 4/1993 | Schuette | |
| 5,613,341 A | | 3/1997 | Skillern | |
| 5,636,483 A | | 6/1997 | Wille | |
| 5,791,101 A | | 8/1998 | Wallace | |
| 5,983,580 A | | 11/1999 | Carr | |
| 6,088,977 A | | 7/2000 | Lawrence | |
| 6,125,598 A | | 10/2000 | Lanphier | |

FOREIGN PATENT DOCUMENTS

| | | | | |
|---|---|---|---|---|
| JP | 406294192 A | * | 10/1994 | 52/182 |

* cited by examiner

*Primary Examiner*—Naoko Slack
(74) *Attorney, Agent, or Firm*—Kolisch Hartwell, P.C.

(57) ABSTRACT

A step support method for use in the manufacturing of straight or curved stairs comprising a plurality of cutouts and a plurality of formed flanges in a contiguous sheet of metal creating a surface for stair treads and risers to be attached. The design of which allows the embodiment to serve structurally as being load bearing. With the addition of slits in the tread support flange, the embodiment can be applied to the manufacturing of curved stairs as well.

2 Claims, 6 Drawing Sheets

4.4

STEP SUPPORT METHOD FOR USE IN THE MANUFACTURING OF STRAIGHT OR CURVED STAIRS

CROSS-REFERENCE TO RELATED APPLICATIONS

This application is a continuation of U.S. patent application Ser. No. 09/803,164, filed Mar. 9, 2001, now abandoned and entitled "A Step Support Method for Use in the Manufacturing of Straight or Curved Stairs" which is a continuation-in-part of U.S. patent application Ser. No. 09/419,226, filed Oct. 15, 1999, now abandoned and entitled "Method and Apparatus for Making Stairs", which claims priority to U.S. Provisional Patent Application Ser. No. 60/104,574, filed on Oct. 16, 1998 and entitled "Method and Apparatus for Making Stairs".

BACKGROUND OF THE INVENTION

The present invention relates generally to a method and means for making stairs The invented method allows rapid, efficient, accurate, and economical construction of stairs, either straight or curved, whether a single step or an entire flight of steps. The invented method is surprisingly adaptable to a variety of stairways and produces steps that are incredibly quiet and squeak free. Furthermore, the invented method allows the production of a flight of steps of unlimited length and a surprisingly sturdy means of support.

Conventional stairs for residential construction include a stringer made from a 2×12 piece of wood, with triangular portions of the stringer cut away to define the rise and run of each step. This construction requires that each triangle of removed material be marked and cut separately, involving much labor and presenting numerous opportunities for error and injury. It also results in a stringer having an effective structural thickness of only about half the thickness of the original 2×12 piece of lumber with approximately one-quarter of the original 2×12 piece being thrown away and therefore wasted.

The conventional method of stair construction has additional problems. The moisture content of the good is an inherent variable in that, as the wood dries, it shrinks in size allowing nail's or screws to loosen in time and cause squeaks. It also produces an "out-of-square" condition as the flood shrinks in width at a rate more pronounced than it does in length. This creates a need to relevel the tread and risers with the use of shims so that the finished tread and riser surfaces will be square to each other.

There is also a common problem in the use of the conventional method for exterior use where there is more exposure to the elements. Wood that repeatedly gets wet and dries out will split, again loosening nails or screws. The triangular portion holding the tread and riser inevitably breaks off.

Another inherent problem with the conventional method is with the use of dimensional lumber and finding a good, straight board, without knots in longer lengths.

Other attempts at solving the problems of conventional construction techniques for stairs take a modularized approach. Two examples of modularized stairs are shown in U.S. Pat. Nos. 1,925,642 and 4,875,315, the disclosures of which are incorporated herein by reference. In these patents, a composite stringer is made from triangular-shaped blocks attached to a stringer of approximately 2×6-inches in size, using a tongue-and-groove connection. In each of these disclosures, the stringer must be cut separately if the rise or run of the stairs varies from a predetermined rise and run.

Other prior art, including U.S. Pat. Nos. 2,724,466; 4,015,687; 4,106,591; 4,635,416; 4,709,520; 4,866,894; and 5,205,093, the disclosures of which are incorporated herein, disclose various brackets for use with unaltered structural lumber or steel. However, several of these have a predefined rise and run for each step or to the extent that some adjustability is allowed are labor-intensive and unwieldy in application.

New construction techniques such as those applied in construction of metal framed homes require, due to fire codes, that the stairs be constructed of steel. Attempts at solving this problem include my previous U.S. Pat. No. 6,088,977, as well as U.S. Pat. No. 5,791,101 (Wallace) where the use of a bracket or a component was implied to secure the tread and riser. This helps, however it requires the addition of shim material to create a smooth surface to apply the finish materials to the outside surface of the finished stringer. There is assembly time and use of fasteners or other components. The present invention solves all of the above identified problems.

It is the object of the present invention to provide a device and method that is economical to manufacture and that may be used to make stairs accurately efficiently, and securely.

It is a further object of the present invention to provide a method of making curved stairs with a tight radius.

It is a further object of the present invention to provide a method of making stairs straight or curved.

It is a further object of the present invention to provide a method that reduces the amount of lumber that is wasted in the manufacturing of stairs.

Additional objects and advantages of the present invention will be understood more readily after a consideration of the drawings and the Detailed Description of the Preferred Embodiment.

The embodiment can be fabricated from one contiguous piece of sheet metal or several smaller pieces joined together by means of welding, fasteners, etc. A desired rise and run are then cut out with the allowance for extra material to provide for the tread and riser support flanges.

The flanges are then formed inward to create a surface for attaching treads and risers. A flange is formed on the bottom edge of the stringer to create a surface whereby structural or finished material can be applied, as well as increase rigidity in the embodiment.

Flanges are provided for mounting or attaching to a structure.

The contiguous surface of the invention yielded surprising results. It provided a load carrying support for the tread surfaces that resisted bouncing when loads were applied. The application of a bottom flange added more rigidity.

It is also believed that the tread support flanges cooperates with most conventional fasteners to provide an attachment that is secure and very resistant to squeaking or making other noises as weight is transferred onto and off the step. For optimum results, screws or fasteners that attach by means of threads should be used.

The use of sheet metal eliminates all the inherent disadvantages found in dimensional lumber, such as the cracking caused by moisture fluctuations as well as the loosening of fasteners and shrinkage incurred in wood. It also provides safety due to it being fire resistant.

Another advantage is the consistency and uniformity found in metals. It makes for accurate calculations for determining load capacity.

There is very little waste as the pieces can be nested on a standard size sheet of metal, then cut out through the implementation of laser, waterjet, plasma, or stamping dies.

All scrap produced can be recycled through conventional means. With properly plated or with proper coatings applied, the invention will weather outside fully exposed to the elements without failure.

Since there are no attached pieces as in the modular method of stair construction there are fewer fasteners that can fail and no need to shim surfaces to create a smooth outer surface on which to apply finishes such as veneers or paint.

With the addition of slits to the tread support flange, the preferred embodiment can be flexed or curved to create a wide variety of configurations. The addition of laminated materials to the surface of the invention increases strength by preventing the sheet metal from distorting, as well as providing a surface to attach finished or structural materials.

On multiple-stringer stair systems the flanges can be formed away from the outside finished surface so that they conveniently stack one into the other, reducing shelf space as well as shipping space and thereby reducing freight costs.

DETAILED DESCRIPTION OF THE PREFERRED EMBODIMENT

Figure 1:
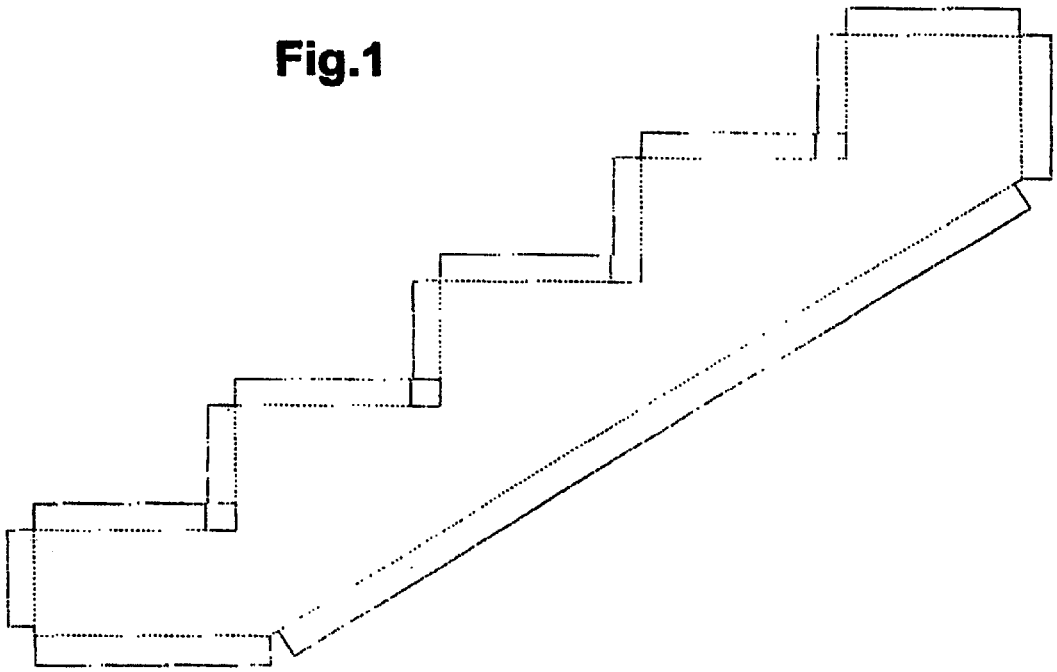
FIG. 1 is a side elevation of the invented stair stringer cut out for use in manufacturing a straight flight of stairs shown prior to the forming of the flanges. The dotted lines represent the fold line for the flanges.

Referring to FIG. 1, a continuous piece of sheet metal according to the present invention has a plurality of cut outs corresponding to the desired rise and run of the desired stair case. Additional material is provided to allow flanges to be produced when formed. The flanges provide a sturdy surface wherein stair treads and risers can be attached. Fasteners such as self-tapping sheet metal screws have been found to work well. The present invention allows for no limit in the length of the stair stringer as the gauge of metal thickness can be increased to accommodate heavier loads or longer lengths. Multiple pieces of metal can be welded together to create the stair stringer cutout if coil stock is unavailable.

Figure 2:
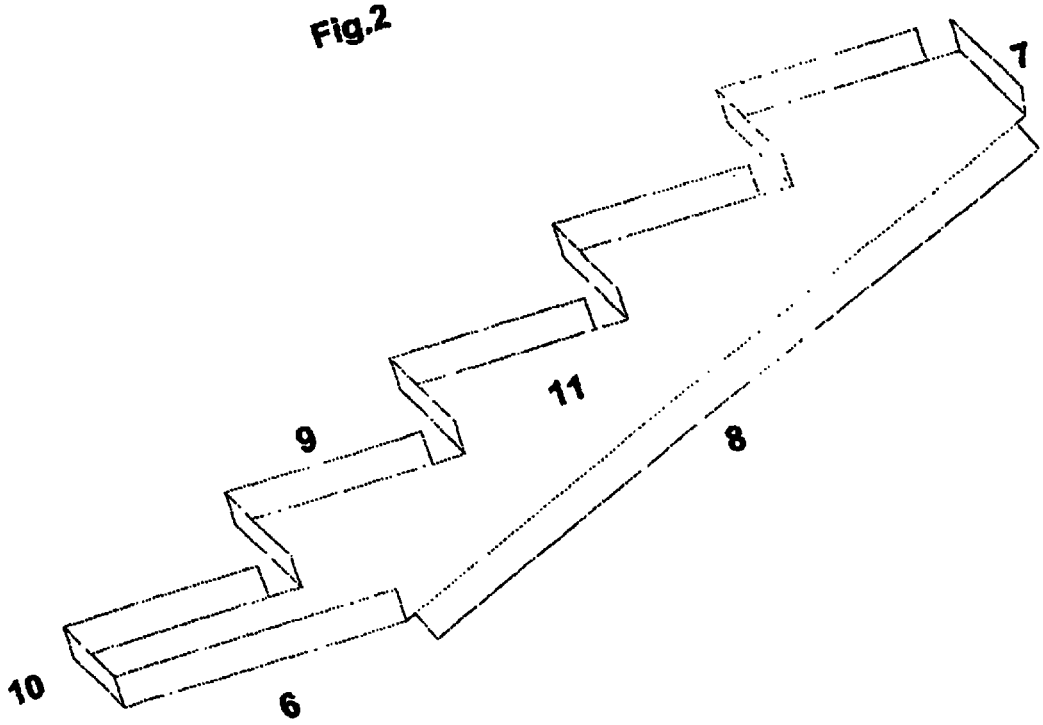
FIG. 2 is an isometric view of FIG. 1 with the flanges formed upward with the exception of the bottom flange 8 still unformed for viewing clarity purposes.

Referring to FIG. 2, the flange 9 provides an attaching surface for the treads. Flange 10 provides an attaching surface for the risers. Flange 6 provides an attaching surface to the floor or base of a structure, where as 7 provides an attaching surface for the upper floor or level of a structure. Despite the thickness of the material used, the load bearing surface 11 surprisingly withstood tremendous loads in excess of one-thousand pounds in test samples. With the addition of the bottom flange 8 it withstood loads well in excess of all current building code requirements in the United States.

Figure 3:
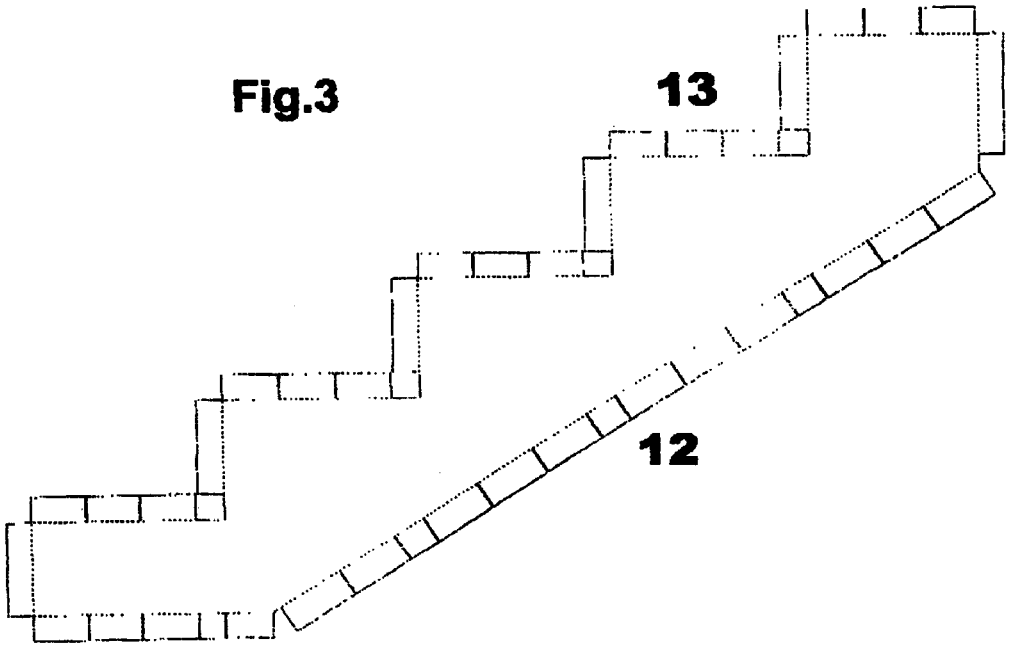
FIG. 3 is a side elevation of the invented stair stringer cut out for use in manufacturing a curved flight of stairs shown prior to the forming of the flanges. The dotted lines represent the fold lines for the flanges. Also shown are the slits in the tread support flange 13 as well as the bottom flange 12.

Referring to FIG. 3, the addition of slits in the tread support surface 13 and bottom flange 12 allows A wide variety of configurations to be achieved as well as the ability to curve around tight radii. It should be noted on curved stair work that it may be preferable to use no bottom flange 12. It has been found to be preferable to laminate multiple layers of plywood to create a surface wherein to attach finished materials to the underside of the staircase. It serves this purpose as it also stiffens the vertical load bearing surface referred to in FIG. 2 surface 11 as well.

Figure 4:
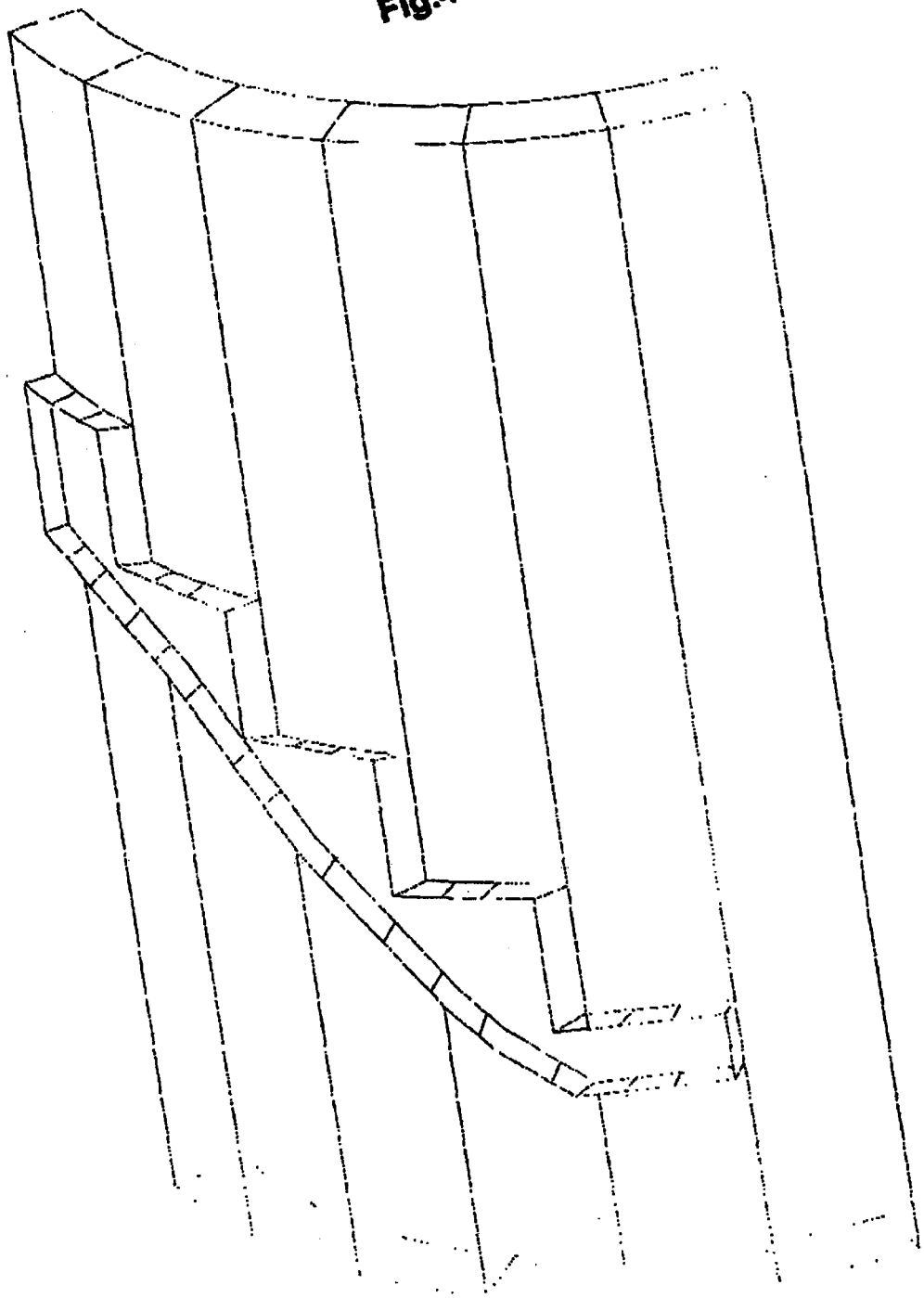
FIG. 4 is an isometric view of the invented stair stringer in FIG. 3 with all flanges being formed and attached to a curved fixture 14, displaying the function of the slits in the tread support flange, the bottom flange, and lower structure mounting flange.

Referring to FIG. 4, when the invented stringer of FIG. 3 is attached to a curved fixture 14, it readily conforms as the slits allow the metal to flex. The frequency of spacing of the slits in the tread support flange allows for tighter radii to be achieved.

Figure 5:
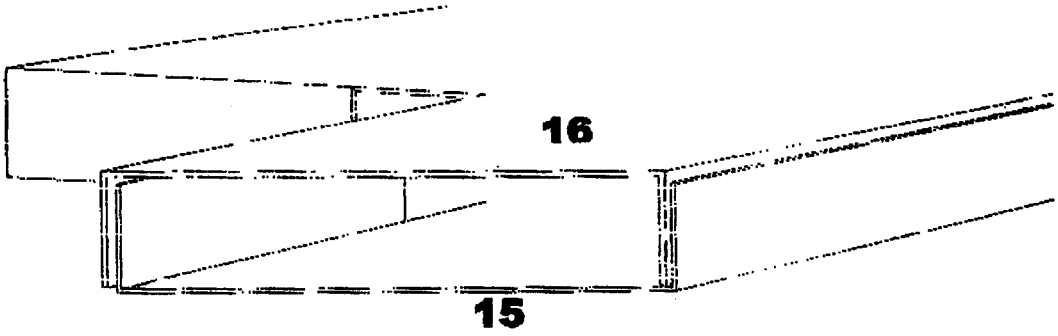
FIG. 5 is an isometric view of two identical invented stair stringers 15 and 16 with the riser support flanges removed for viewing purposes, showing flanges but in opposing directions.

Referring to FIG. 5, the preferred embodiment allows matched stringers 15 and 16 to be stacked together for easy shipping as well as using half the space of dimensional lumber of the same configuration, also taking up less shelf space in a store or lumber yard.

Figure 6:
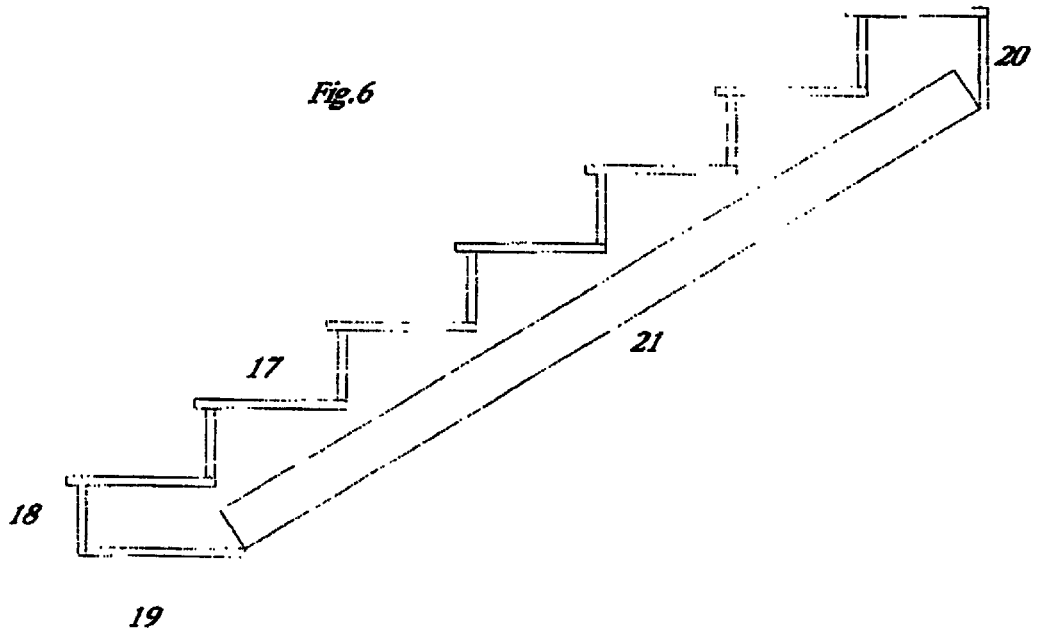
FIG. 6 is a side cutaway view elevation of the invented stair stringer with treads 17 and risers 18 attached with a plurality of fasteners shown with modification of additional material 21, which may be laminated or otherwise added to at least one side of the stringer for increased strength or rigidity.

Referring to FIG. 6, the preferred embodiment of the invention is shown with treads 17 and risers 18 attached with fasteners. The fastener pattern shown has proven to be preferred. Shown also are the bottom attaching plate 19 and the upper attaching plate 20. The mounting flanges of FIG. 2, 6, and 7, can also be mounted directly to the structure. However, it has proven advantageous to install the plywood plates as these space the lower portion of the stringer properly and keep the unit as a whole from getting damaged during shipping. Illustrated is the laminated support strip which takes the place of the bottom flange in FIG. 2, 8. This adds strength as it prevents the load bearing surface of FIG. 2, 11 from buckling as well as provide a surface wherein finished materials can be applied such as gypsum wallboard.

While the present invention has been shown and described by reference to the preferred embodiment, it will be apparent to those skilled in the art that other changes in form and detail may be made therein without departing from the spirit and scope of the invention defined in the claims.

I claim:

1. A step support system for use in manufacturing straight or curved stairs, comprising:

a step-support body formed from a contiguous sheet of metal;

a plurality of cutouts proportionate to the rise and run of a desired step;

a plurality of tread-support flanges to which a plurality of treads may be attached a plurality of riser-support flanges to which a plurality of risers maybe attached;

a flange wherein the step support can be mounted or attached to a structure;

wherein the tread support flanges have slits by which means the step support can flex; and wherein material is laminated on at least one side of the step-support body.

2. The step support of claim 1 with material laminated on at least one side of the step-support body providing a surface whereby finished or structural materials can be attached to the underside of stairs.

* * * * *